US007404601B2

(12) United States Patent
Chen

(10) Patent No.: US 7,404,601 B2
(45) Date of Patent: Jul. 29, 2008

(54) LIGHT-WEIGHT FOLDABLE CHAIR FOR LEISURE

(76) Inventor: Libin Chen, Qiaoyu Building, West of Boyi Town, Changzhou, Jiangsu (CN) 213147

( * ) Notice: Subject to any disclaimer, the term of this patent is extended or adjusted under 35 U.S.C. 154(b) by 473 days.

(21) Appl. No.: 11/219,165

(22) Filed: Sep. 2, 2005

(65) Prior Publication Data

US 2007/0187998 A1 Aug. 16, 2007

(30) Foreign Application Priority Data

Mar. 24, 2005 (CN) ..... 2005 2 0070078 U

(51) Int. Cl.
*A47C 4/00* (2006.01)

(52) U.S. Cl. ..... 297/16.2; 297/16.1; 297/45; 297/440.11; 297/42

(58) Field of Classification Search ..... 297/16.2, 297/16.1, 45, 440.11, 42
See application file for complete search history.

(56) References Cited

U.S. PATENT DOCUMENTS 2,733,755 A * 2/1956 Boucher ..... 297/411.41
5,499,857 A * 3/1996 Lynch, Jr. ..... 297/16.2
5,984,406 A * 11/1999 Lee ..... 297/16.2
6,082,813 A * 7/2000 Chen ..... 297/16.2
6,302,479 B1 * 10/2001 Zheng ..... 297/16.2
6,322,138 B1 * 11/2001 Tang ..... 297/45
6,332,646 B1 * 12/2001 Tseng ..... 297/16.1
6,447,057 B1 * 9/2002 Chen ..... 297/16.2
6,702,371 B2 * 3/2004 Zheng ..... 297/16.2
6,752,414 B1 * 6/2004 Waldron et al. ..... 280/649
6,848,740 B1 * 2/2005 Reese ..... 297/16.1
6,957,852 B1 * 10/2005 Hsieh ..... 297/46
7,011,372 B1 * 3/2006 Hsieh ..... 297/440.24
7,258,361 B2 * 8/2007 Haury et al. ..... 280/649
7,328,940 B2 * 2/2008 Zheng ..... 297/44

* cited by examiner

*Primary Examiner*—Laurie K Cranmer
(74) *Attorney, Agent, or Firm*—Ohlandt, Greeley, Ruggiero & Perle L.L.P.

(57) ABSTRACT

This invention relates to a light-weight foldable chair for leisure with seat and backrest loop capable to be folded once, which can be used in households, outdoors, in a courtyard, in a park and at the beach.

10 Claims, 9 Drawing Sheets

LIGHT-WEIGHT FOLDABLE CHAIR FOR LEISURE

REFERENCES TO RELATED APPLICATIONS

The present application is claiming priority of Chinese Patent Application No. 200520070078.7, filed on Mar. 24, 2005, the content of which is herein incorporated by reference.

BACKGROUND OF THE INVENTION

1. Field of the Invention

This invention relates to a chair for leisure with seat, backrest, armrest and frame folded once, in particular to a light-weight foldable chair for leisure that can be used in a variety of environments including, for example, in households, outdoors, in a courtyard, in a park, and at beach.

2. Description of the Related Art

At present, the foldable chair suitable for travel and leisure on the market is configured with only supports, backrest tubes and fabric connected. When unfolded, the chair is dragged by the fabric on the seat, which bears a great force and is likely to be damaged. So, one feels uncomfortable while sitting. The existing well known seat-loop foldable chair is configured with its upper portion made of an entire circle, unable to be folded, and having a large volume. The chair seat employs an insert-type structure, having a positioning and fixing device. When the chair is to be folded, it is necessary to open the fixing device first, and it is inconvenient for folding. The chair has a large volume after being folded, and so is inconvenient for carrying.

BRIEF SUMMARY OF THE INVENTION

The present invention provides a light-weight foldable chair for leisure that overcomes the above-mentioned defects. The chair has a seat, a back-rest and armrest, and quadrangle frame, convenient to be folded together, easy in use and for carrying, and having a good stability. A person feels comfortable when sitting in the chair, The light-weight foldable chair for leisure of this invention is achieved by the following embodiments:

In one embodiment, the light-weight foldable chair for leisure of this invention comprises fabric for seat and backrest, two seating frame armrest tubes, two backrest tubes, two backrest support tubes, two seating frame support tubes, crossed support tubes, two rotatable joint members, two sliding disks, two seat disks, four foot disks; said crossed support tubes having front crossed tubes, rear crossed tubes, side crossed support tubes, and between the two seating frame support tubes are disposed the front crossed support tubes, which are hinged to each other, at the upper portions of each of the two seating frame support tubes is disposed the seat disk; the upper portion of the front crossed support tube and the seat disk are movably connected; the lower portion of the front crossed support tube is connected to the foot disk; at the upper end of the seating frame support tube is disposed the rotatable joint member via a U-shaped hinging member, and at the lower end of the seating frame support tube is disposed a sliding sleeve, which is sleeved on the side crossed support tube; between the two backrest support tubes is disposed a rear crossed tube, the upper end of which is connected to the sliding disk, and the lower end of which is movably connected to the foot disk; said sliding disk is sleeved on the backrest support tube; at the upper ends of the two backrest support tubes are disposed rotatable joint members via the U-shaped hinging member, and the lower ends of the two backrest support tubes are mounted on the foot disks; between the two backrest support tubes and the two seating frame support are disposed side crossed support tubes respectively; the side crossed support tubes are hinged to each other, wherein the upper end of one of the side crossed support tubes is movably connected to the seat disk, and the lower end thereof is movably connected to the foot disk; the two backrest tubes are connected and clipped to the rotatable joint member on the upper end of the backrest support tube via a long joint member, and the two seating frame armrest tubes are connected and clipped to the rotatable joint member on the upper end of the seating frame support tube via another long joint member; between the two seating frame armrest tubes and two backrest tubes are connected respectively via a short joint member, and the two seating frame armrest tubes and two backrest tubes are sleeved with fabric.

The light-weight foldable chair for leisure of this invention has the following features and advantages:

When using the light-weight foldable chair for leisure, one can first open the folded chair, with two hands holding the two long joint members respectively to pull outward. Thus, the sliding sleeve slides downward along the two side crossed support tubes, while the sliding disk slides downward along the backrest support tubes; the fabric will spread together with the backrest tubes and seating frame armrest tubes, and the U-shaped hinging member mounted on the upper portions of the seating frame support tubes and backrest support tubes will bring along rotation of the rotatable joint member. The chair can be used just by pulling out the backrest tubes and the seating frame armrest tubes.

To fold the chair, one just holds the two joint members to pull upward, and furl inward, thus, the sliding sleeve and sliding disk will slide upward, allowing the crossed support tubes to furl inward, while the backrest tube and seating frame armrest tube will be folded inward to an integral, easy for carrying.

The light-weight foldable chair for leisure of this invention is reasonably designed, compact in structure, elegant in appearance design, convenient in use and comfortable for sitting and resting. The chair employs a quadrangle chair support, having a good stability. The backrest tubes and the seating frame armrest tubes are assembled by two modules, easy for folding. The chair, after being folded, has a much smaller volume than a circular foldable chair, so it is convenient for packaging and carrying.

DETAILED DESCRIPTION OF THE INVENTION

Specific examples of this invention will be described in conjunction with the drawings.

Figure 1:
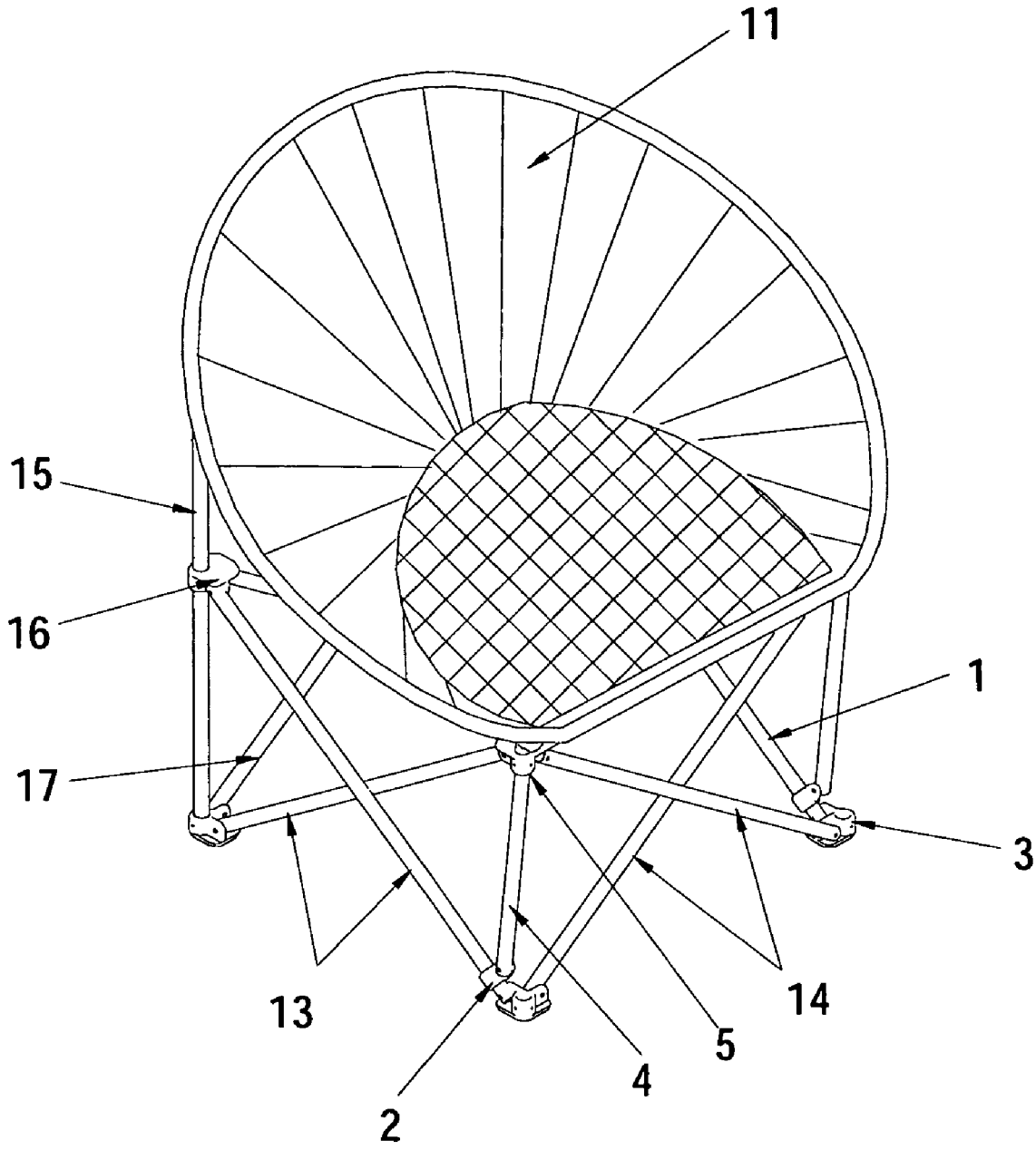
FIG. 1 is a schematic view of a light-weight foldable chair for leisure according to this invention.
Figure 2:
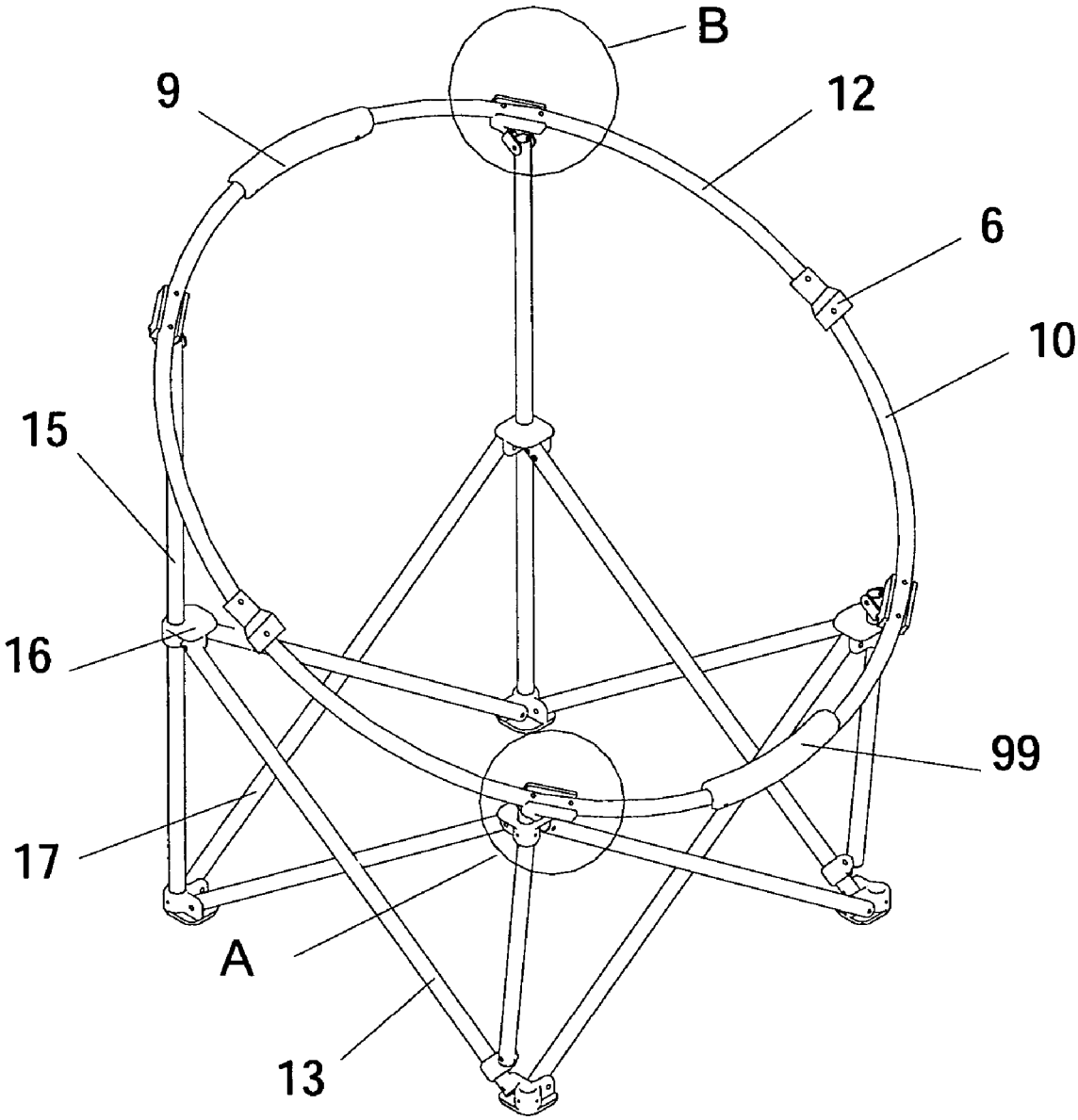
FIG. 2 is a structural view of an example of the seat loop and chair support of the light-weight foldable chair for leisure according to this invention.
Figure 13:
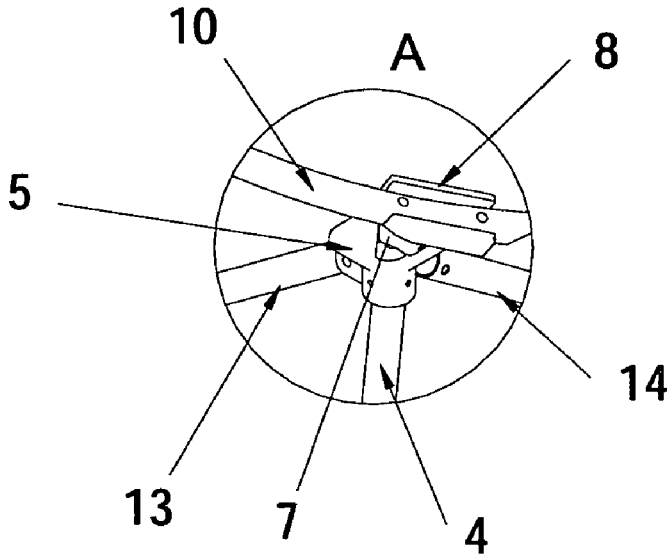
FIGS. 13 and 14 are the partially amplified views of parts A and B in FIG. 2 respectively.
Figure 14:
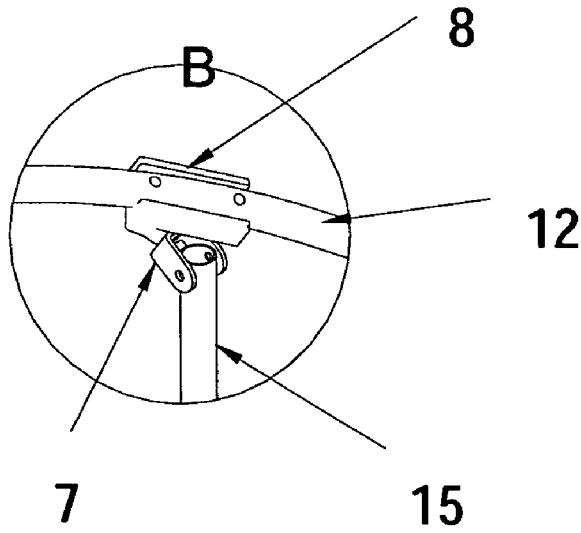

Referring to FIGS. 1 and 2, FIG. 1 is a schematic view of a light-weight foldable chair for leisure according to this invention; FIG. 2 is a structural view of an example of the seat circle and chair support of the light-weight foldable chair for leisure according to this invention; meanwhile, referring to FIGS. 13 and 14, which are the partially amplified views of parts A and B in FIG. 2 respectively. The light-weight foldable chair for leisure of this invention comprises fabric for seat and backrest 11, seating frame armrest tubes 10, backrest tubes 12, backrest support tubes 15, seating frame support tubes 4, crossed support tubes, rotatable joint members 8, sliding disks 16, seat disks 5, foot disks 3; except for the fabric 11 for seat and backrest, four foot disks 3 and the crossed support tubes, all the above members are disposed symmetrically left and right, but the reference numbers are marked only on one member. The crossed support tubes include front crossed tubes 14, rear crossed tubes 17, side crossed support tubes 1, 13. Between the two seating frame support tubes 4 are disposed front crossed support tubes 14, which are hinged to each other, their upper portions are connected movably to the seat disks 5, and the lower portions are connected to the foot disks 3. At the upper portion of each of the two seating frame support tubes 4 is disposed a seat disk 5; the two seating frame support tubes 4 penetrate the fitting hole 52 of the seat disk 5; at the upper ends of the seating frame support tubes 4 are disposed rotatable joint members 8 via a U-shaped hinging member 7. Please refer to FIGS. 4 and 9 at the same time, the joint hole 72 passing through the U-shaped hinging member 7 via the joint member is connected to the upper end of the seating frame support tubes 4, and the joint hole 73 of the U-shaped hinging member 7 is connected to the fixing hole 83 of the rotatable joint member 8 via another joint member. The lower end of each of the seating frame support tubes 4 is connected the sliding sleeve 2, which is sleeved on the side crossed support tubes 1, 13. Between the two backrest support tubes 15 is disposed a rear crossed tube 17, the upper end of which is connected to the sliding disk 16, and the lower end of which is movably connected to the foot disk 3; said sliding disk 16 is sleeved on the backrest support tube 15, and can slide along the backrest support tube 15 while folding or unfolding. At the upper ends of the two backrest support tubes 15 are disposed rotatable joint members 8 via the U-shaped hinging member 7, and the lower ends of the two backrest support tubes 15 are mounted on the foot disks 3. Between the two backrest support tubes 15 and the two seating frame supports 4 are disposed side crossed support tubes 1, 13 respectively; the side crossed support tubes are hinged to each other, wherein the upper end of one of the side crossed support tubes is movably connected to the seat disk 5, and the lower end thereof is movably connected to the foot disk 3; the upper end of the other one of the side crossed support tubes is movably connected to the sliding disk 16, and the lower end thereof is movably connected to the foot disk 3. The two backrest tubes 12 are and clipped to the rotatable joint member 8 on the upper end of the backrest support tube and connected thereto via a long joint member 9. The two seating frame armrest tubes 10 are clipped to the rotatable joint member 8 on the upper end of the seating frame support tube 4 and connected thereto via another long joint member 99. Between the two seating frame armrest tubes 10 and two backrest tubes 12 are connected respectively via a short joint member 6, and the seating frame armrest tubes 10 and backrest tubes 12 are sleeved with fabric for seat and backrest. The seat and backrest loop formed by the two seating frame armrest tubes 10 and the two backrest tubes can be designed into any different shapes, such as a circle, an ellipse, or more than half circle.

Figure 3:
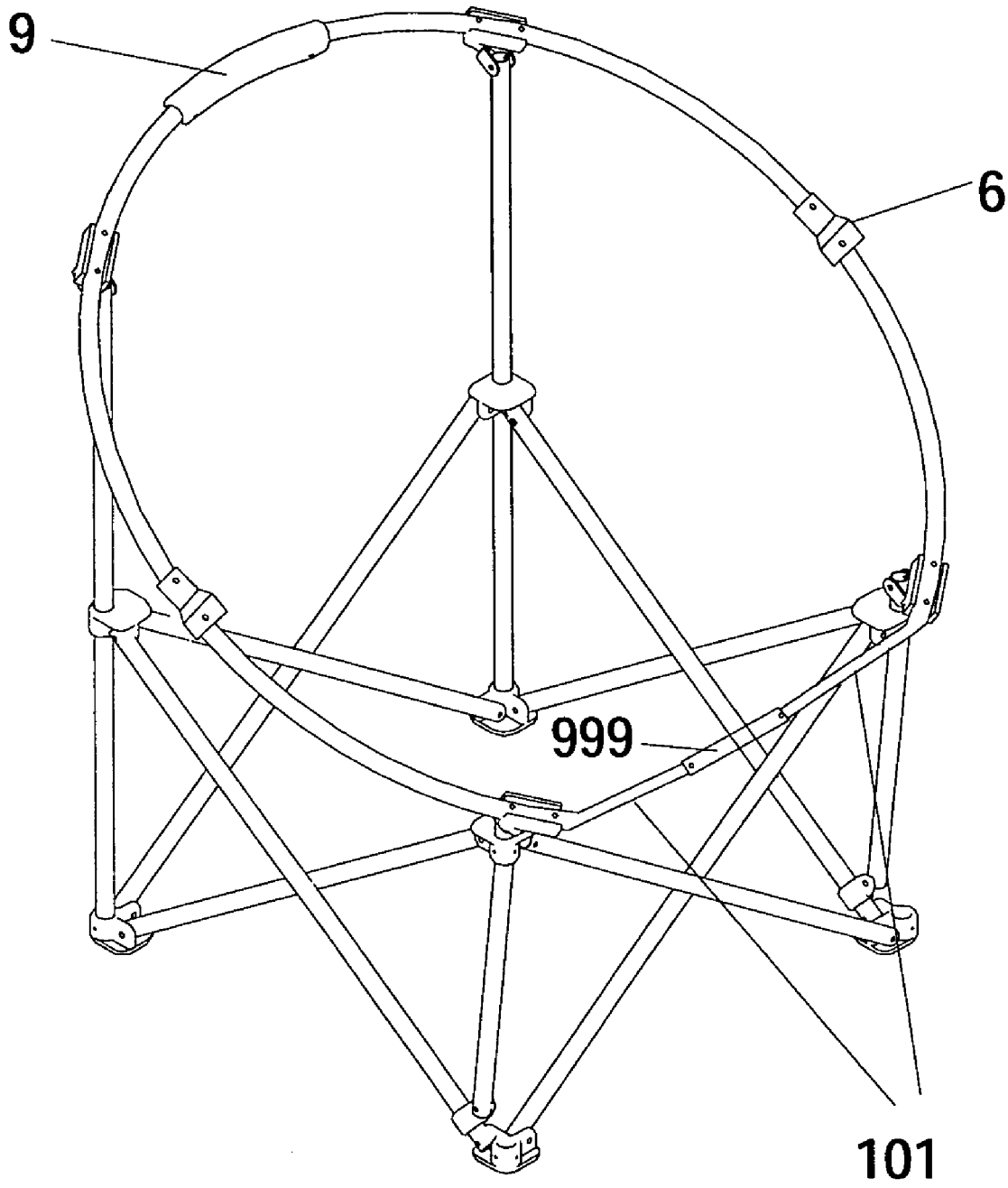
FIG. 3 is a structural view of another example of the seat loop and chair support of the light-weight foldable chair for leisure according to this invention.

FIG. 3 shows a structure of another example of the light-weight foldable chair for leisure according to this invention, wherein the two seating frame armrest tubes 10 are connected via a joint plate 999, and the lower ends 101 of the two seating frame armrest tubes 10 are straight, while the structure of other portions is the same as the seat and backrest circle and the chair frame of the light-weight foldable chair for leisure of this invention as shown in FIG. 2.

Figure 4:
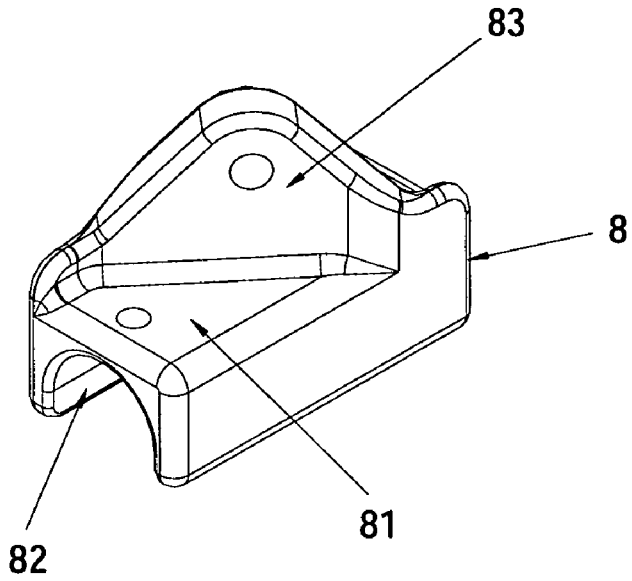
FIG. 4 is a structural view of the rotatable joint member of the light-weight foldable chair for leisure according to this invention.

Referring to FIG. 4, the rotatable joint member 8 of the light-weight foldable chair for leisure of this invention comprises a joint body 81, on which is disposed a U-shaped groove 82, the backrest tube and seating frame armrest tube being fitted therein. The rotatable joint member further comprises a joint protrusion, on which is provided a fixing hole 83 for connecting the U-shaped hinging member.

Figure 5:
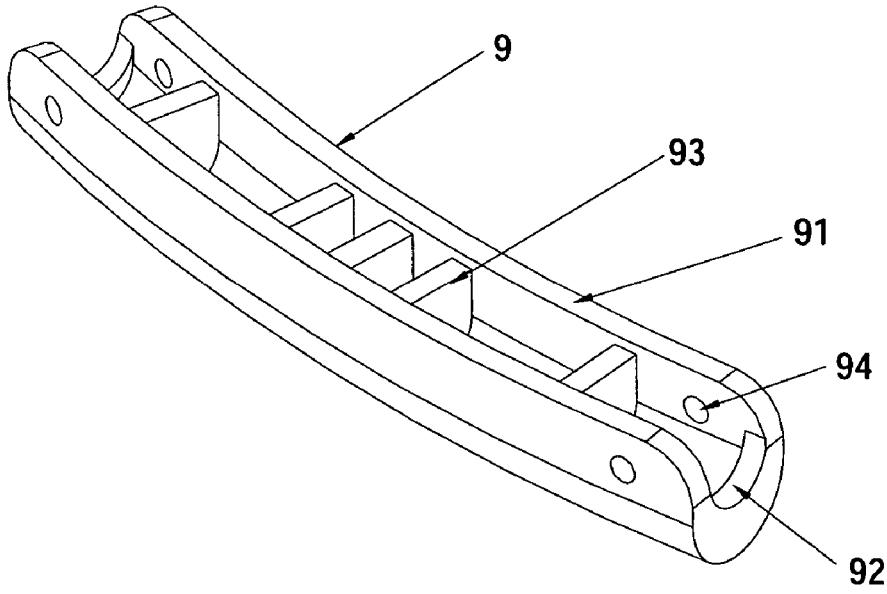
FIG. 5 is a structural view of the long joint member of the light-weight foldable chair for leisure according to this invention.

Referring to FIG. 5, the long joint member 9 of the light-weight foldable chair for leisure of this invention comprises a joint body 91, on which are disposed two grooves 92 at both ends of the joint body, reinforced ribs 93 and joint holes for tubes 94. One end of the backrest tube and the seating frame armrest tube is fitted to the groove 92, the pipe fittings 12, 10 being movably connected to the grooves by penetrating the rivet or bolt through the tube joint hole 94.

Figure 6A:
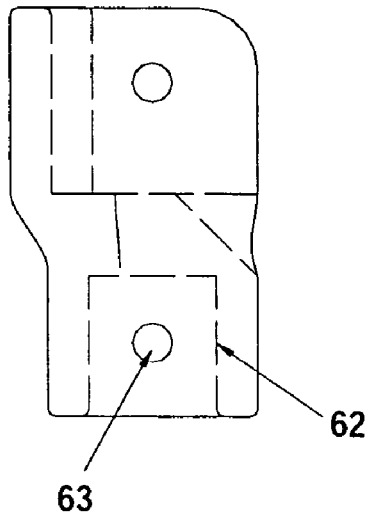
FIG. 6*a* is a front structural view of the short joint member of the light-weight foldable chair for leisure according to this invention.
Figure 6B:
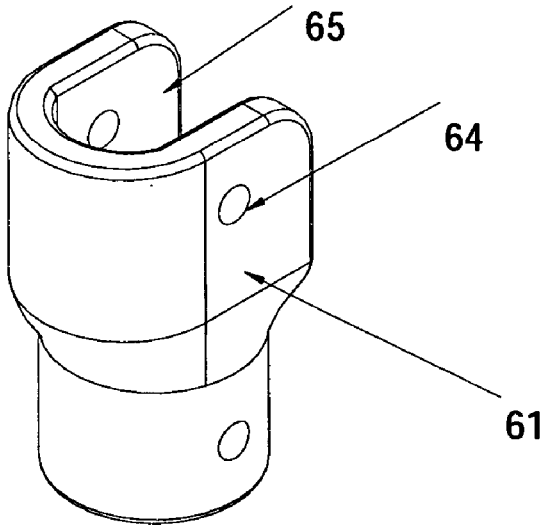
FIG. 6*b* is a perspective structural view thereof.

Referring to FIGS. 6*a*, 6*b*, the short joint member 6 of the light-weight foldable chair for leisure of this invention comprises a joint body 61, on one end of which is disposed a tube fitting hole 62, a tube joint hole 63, on the other end of which is disposed a tube joint groove 65, beside the joint groove 65 being disposed a joint hole 64. The pipe fittings 12, 10 can be disposed in the tube fitting hole 62 and tube joint groove 65 respectively, each of the above pipe fittings 12, 10 being movably connected to the short joint pipe fittings 6 by penetrating rivet or bolt through the tubing joint holes 63 and 64.

Figure 7:
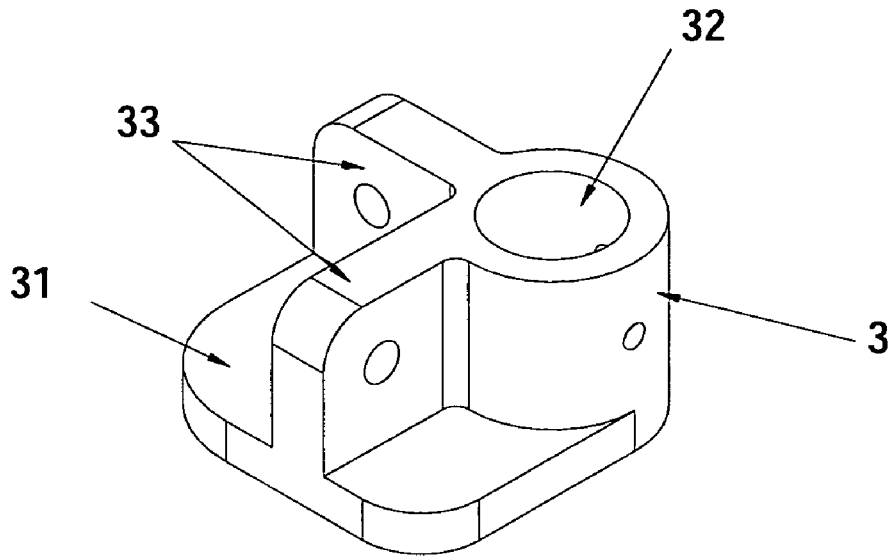
FIG. 7 is a structural view of the foot disk of the light-weight foldable chair for leisure according to this invention.

Referring to FIG. 7, the foot disk 3 of the light-weight foldable chair for leisure of this invention comprises a base seat 31, at the upper portion of which is provided a pipe fitting insert hole 32, and two pipe fitting joint protrusions 33 connected to the outer sidewall thereof. The joint protrusions 33 can fix the crossed support tubes, and the lower ends of the backrest support tube 15 and the seating frame support tube 4 can be inserted and fixed into the pipe fittings insert hole 32.

Figure 8:
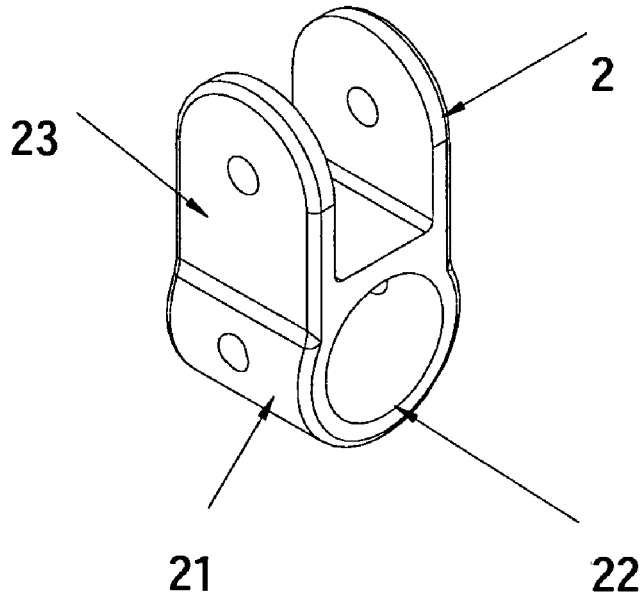
FIG. 8 is a structural view of the sliding sleeve of the light-weight foldable chair for leisure according to this invention.

Referring to FIG. 8, the sliding sleeve 2 of the light-weight foldable chair for leisure of this invention comprises a sliding sleeve body 21, on which is provided a sliding sleeve hole 22, on the side of the sliding sleeve body 21 is provided a pipe fittings joint protrusion 23. As shown in FIG. 1, the side crossed support tubes 1, 13 are sleeved in the sliding sleeve hole 22, and the seating frame support tube 4 is movably connected to the sliding sleeve 2 via the hole on the pipe fittings joint protrusion 23.

Figure 9:
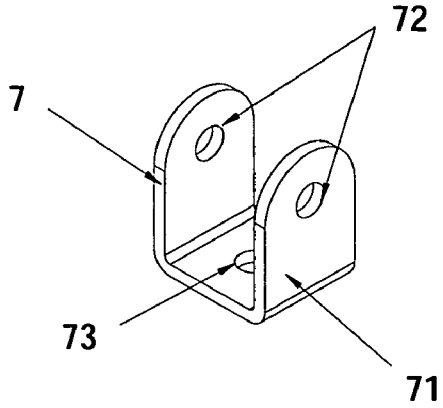
FIG. 9 is a structural view of the U-shaped hinging member of the light-weight foldable chair for leisure according to this invention.

Referring to FIG. 9, the U-shaped hinging member 7 of the light-weight foldable chair for leisure of this invention comprises a joint piece 71 for the U-shaped hinging member, on which is provided pipe fitting joint holes 72, 73.

Figure 10:
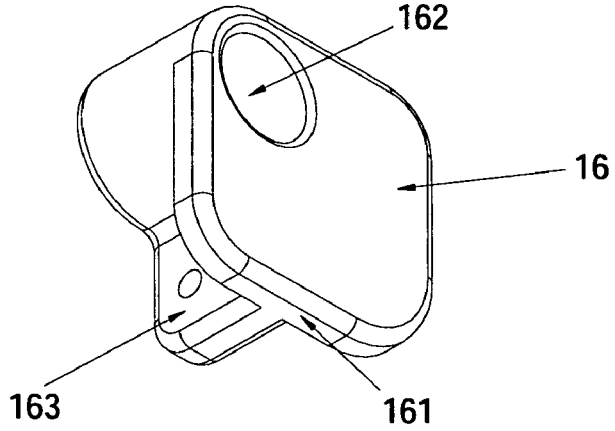
FIG. 10 is a structural view of the sliding disk of the light-weight foldable chair for leisure according to this invention.

Referring to FIG. 10, the sliding disk 16 of the light-weight foldable chair for leisure of this invention comprises a sliding disk body 161, on which is provided a sliding hole 162 for sleeving on the backrest support tube 15. On one side of the sliding hole 162 are provided two pipe fitting joint protrusions 163, and the upper end of the crossed support tube is movably connected to the sliding disk 16 via the hole on the pipe fittings joint protrusion 163.

Figure 11:
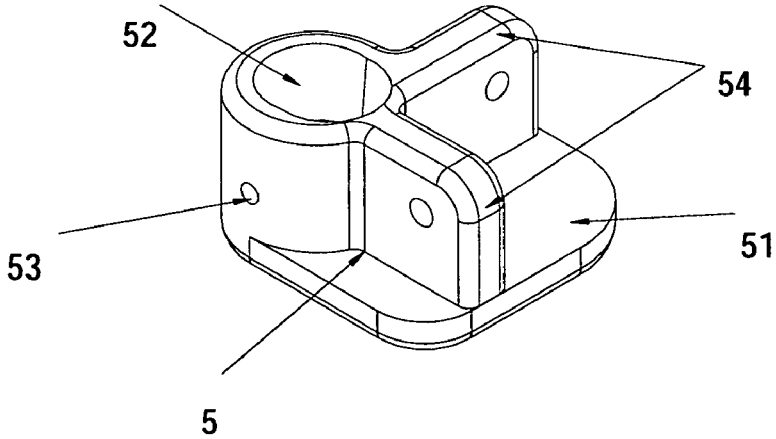
FIG. 11 is a structural view of the seating disk of the light-weight foldable chair for leisure according to this invention.
Figure 12:
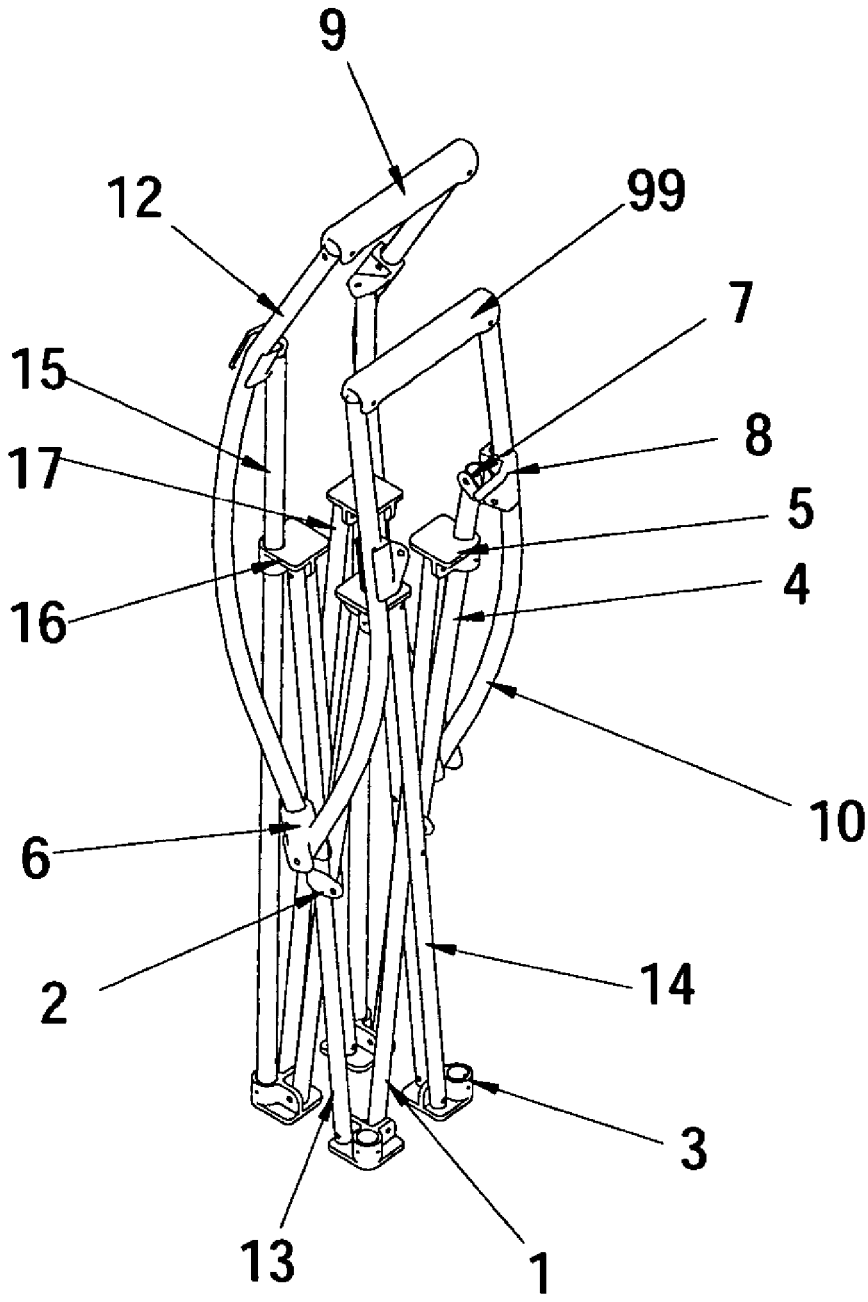
FIG. 12 is a structural view of the light-weight foldable chair for leisure in a folding state according to this invention.

Referring to FIG. 11, the seating disk 5 of the light-weight foldable chair for leisure of this invention comprises a seating disk body 51, on which is provided a pipe fittings fitting hole 52, the seating frame support tube 4 being sleeved in the pipe fittings fitting hole 52. At one side of the fitting hole 52 is provided a positioning hole 53, and on the seating disk body 51 are provided two pipe fittings joint protrusions 54. Their connecting function is similar to the sliding disk 16, whereas on the wall surface of the pipe fittings fitting hole 52 is provided a fixing hole for fixing the seating frame support tube 4.

What is described above is only the specific example of this invention, and cannot be construed as limitation to the scope of examples of this invention. All equivalent variations and modifications made in the light of this patent application for an invention and the specification shall fall within the scope as defined by the appended claims.

The invention claimed is:

1. A light-weight foldable chair, comprising:

a fabric for a seat and a backrest;

two seating frame armrest tubes;

two backrest tubes;

two backrest support tubes;

two seating frame support tubes;

a plurality of crossed support tubes;

two rotatable joint members;

two sliding disks;

two seat disks; and four foot disks, wherein said plurality of crossed support tubes have a plurality of front crossed tubes, a plurality of rear crossed tubes, and a plurality of side crossed support tubes, wherein the plurality of front crossed support tubes are between the two seating frame support tubes, wherein the plurality of front crossed support tubes are hinged to the two seating frame support tubes, wherein each of the two seating frame support tubes have an upper portion with one of the two seat disks disposed thereon, wherein each of the plurality of front crossed support tubes have an upper portion movably connected to one of the two seat disks and a lower portion connected to one of the four foot disks;

wherein each of the two seating frame support tubes have an upper end disposed on one of the two rotatable joint members via a first U-shaped hinging member and a lower end disposed on a sliding sleeve which is sleeved on one of the plurality of side crossed support tubes, wherein the plurality of rear crossed tubes are between the two backrest support tubes, wherein each of the plurality of rear crossed tubes have an upper end connected to a sliding disk and a lower end movably connected to one of the four foot disks, said sliding disk is sleeved on one of the backrest support tubes, wherein each of the two backrest support tubes have an upper end disposed on one of two rotatable joint members via a second U-shaped hinging member and a lower end mounted on one of the four foot disks, wherein the plurality of side crossed support tubes are between the two backrest support tubes and the two seating frame support tubes, wherein each of the plurality of side crossed support tubes are hinged to another one of the plurality of side crossed support tubes, wherein one of the side crossed support tubes has an upper end movably connected to one of the two seat disks and a lower end movably connected to one of the four foot disks, each of the two backrest tubes are connected and clipped to one of the two rotatable joint members on an upper end of one of the two backrest support tubes via a first long joint member, wherein the two seating frame armrest tubes are connected and clipped to one of the two rotatable joint members on the upper end of one of two the seating frame support tubes via a second long joint member, and two seating frame armrest tubes and two backrest tubes are connected via at least one short joint member, and wherein the two seating frame armrest tubes and the two backrest tubes are sleeved with the fabric.

2. The light-weight foldable chair according to claim 1, wherein the two seating frame armrest tubes and the two backrest tubes form a seat and backrest loop that is furled together when folded and has a shape selected from the group consisting essentially of a circle, an ellipse, and more than half circle.

3. The light-weight foldable chair according to claim 2, wherein each of said four foot disks have a base seat with a pipe fittings insert hole, and wherein said pipe fittings insert hole has a side with two pipe fittings joint protrusions.

4. The light-weight foldable chair according to claim 2, wherein said first and second U-shaped hinging members have a joint piece for the U-shaped hinging member with a pipe fittings joint hole.

5. The light-weight foldable chair according to claim 1, wherein the two rotatable joint members have a joint body, and wherein the joint body has a U-shaped tube groove and a joint protrusion.

6. The light-weight foldable chair according to claim 1, wherein said first and second longer joint members have a joint member body with two tube grooves, a plurality of pipe fittings joint holes, and a plurality of reinforced ribs.

7. The light-weight foldable chair according to claim 1, wherein the at least one shorter joint member has a joint member body with a pipe fittings fitting groove and a pipe fittings joint hole.

8. The light-weight foldable chair according to claim 1, wherein said sliding sleeve has a sliding sleeve body with a sliding sleeve hole and a pipe fittings joint protrusion at a side of the sliding sleeve body.

9. The light-weight foldable chair according to claim 1, wherein each of said two sliding disks have a sliding disk body with a sliding hole, and wherein said sliding hole has a side with two pipe fittings joint protrusions.

10. The light-weight foldable chair for leisure according to claim 1, wherein each of said two seat disks have a seat disk body with a pipe fittings fitting hole, wherein the pipe fittings fitting hole has a side with a positioning hole, and wherein said seat disk body has two joint protrusions.

* * * * *